United States Patent [19]

Sheridan

[11] 4,172,425

[45] Oct. 30, 1979

[54] INCINERATOR WITH IMPROVED MEANS FOR TRANSFERRING BURNING WASTE THROUGH THE COMBUSTION CHAMBER

[75] Inventor: Henry E. Sheridan, Mineral, Va.

[73] Assignee: Consumat Systems, Inc., Richmond, Va.

[21] Appl. No.: 847,053

[22] Filed: Oct. 31, 1977

[51] Int. Cl.[2] ..... F23G 5/00

[52] U.S. Cl. ..... 110/257; 110/212; 110/215; 110/281; 110/291

[58] Field of Search ..... 110/228, 235, 248, 255, 110/257, 259, 281, 282, 267, 268, 289–291, 212, 186; 198/736, 741; 214/23

[56] References Cited

U.S. PATENT DOCUMENTS

| | | | |
|---|---|---|---|
| 1,403,609 | 1/1972 | Leonard et al. | 110/282 |
| 3,172,647 | 3/1965 | Remmey | 432/133 |
| 3,489,109 | 1/1970 | Flowers, Jr. | 110/213 |
| 3,722,433 | 3/1973 | Kramer | 110/215 |
| 3,812,794 | 5/1974 | Taylor | 110/186 |
| 3,855,950 | 12/1974 | Hughes, Jr. et al. | 110/212 |
| 3,863,578 | 2/1975 | Kato et al. | 110/257 |
| 3,985,084 | 10/1976 | Delaplace | 110/281 |

*Primary Examiner*—Henry C. Yuen

*Attorney, Agent, or Firm*—Cushman, Darby & Cushman

[57] ABSTRACT

A controlled air incinerator having an increased capacity for burning waste material and having increased efficiency for completely burning all burnable waste material fed thereto. The controlled air incinerator, which is sometimes referred to as a "starved air" incinerator, requires accurate control of burning conditions so as to provide at all times a discharge of clean flue gases free from pollutants. In the present incinerator, means are provided for transferring the waste material therethrough while burning, the means causing the burning waste material to tumble within the combustion chamber and open up so as to expose to combustion air any unburned but burnable parts of the waste material whereby the oxygen of the combustion air will result in complete combustion. The incinerator system is essentially completely automatic in that the combustion chamber of the system may be loaded without changing burning conditions in the combustion chamber and the waste material loaded therein is progressively moved through the combustion chamber while burning from the inlet end to the discharge end by transfer means, the movement of the burning waste material resulting in more complete combustion. The system further has means for automatically discharging products of combustion, such as ash, from the outlet end of the combustion chamber without disturbing the burning conditions within the combustion chamber.

21 Claims, 7 Drawing Figures

INCINERATOR WITH IMPROVED MEANS FOR TRANSFERRING BURNING WASTE THROUGH THE COMBUSTION CHAMBER

The present invention relates to an improved incinerator system of the type using a controlled air incinerator having means to automatically load waste material into the combustion chamber and then progressively move the burning waste material through the combustion chamber to an outlet end thereof where the resultant ash may be automatically removed. More specifically, the present invention relates to improved transfer ram means operable within the combustion chamber and an improved combustion chamber design wherein the burning waste material being transferred is caused to tumble so as to open up the same to allow the same to be exposed to more combustion air whereby the oxygen thereof can cause complete burning of the waste material. Additionally, the invention contemplates the use of a plurality of transfer rams arranged horizontally in series to operate within the combustion chamber to progressively move the burning waste material from the inlet end of the combustion chamber toward the outlet end of the same whereby the incinerator can have a larger capacity and more efficiently burn waste material.

BACKGROUND OF THE INVENTION

In recent years, there has been deep concern by the general public and municapalities over the pollution of the environment from the discharge of pollution containing gases into the atmosphere from incinerators and the like. Consequently, technology of incinerators has increased in recent years wherein now certain types of controlled air incinerators are able to meet Federal, State and local regulations regarding pollutants in the discharging flue gases. Such an incinerator has been developed wherein burnable waste material may be automatically fed to a combustion chamber, burnt therein and removed therefrom without effecting the burning conditions therein and whereby the flue gases issuing therefrom have a minimum or no pollutants therein. This type of controlled air incinerator is disclosed in U.S. Pat. No. 3,855,950, issued Dec. 24, 1975 to Hughes et al and assigned to the common assignee of this application and for the purpose of this application, the disclosure in the aforementioned patent is incorporated herein by reference.

More recently, with the advent of the problems resulting from an energy crisis because of the shortage of petroleum products and natural gas, efforts are being made to conserve energy where ever possible. With regard to incinerators wherein the temperature of the flue gases is in the order of 1200° to 2400° F. or more, the energy provided by this temperature was completely wasted by early incinerator systems but due to recent awareness of the general energy crisis, efforts have now been made to utilize any energy which can be obtained from the high temperature hot flue gases. In this respect, incinerator systems have been proposed with the provision of a heat exchanger for heat recovery from in the stack system of incinerators, the heat being recovered to convert water into hot water or steam utilized for heating a building or providing a hot water distribution system in a building or for supplying steam for various purposes in plants such as hospitals, textile mills or the like. One such system for recovering energy from the hot flue gases of an incinerator is disclosed in U.S. Pat. No. 3,844,233, issued Oct. 29, 1974 to Fishback and assigned to the common assignee of this application. The subject matter of the disclosure of the Fishback patent is incorporated herein by reference.

One disadvantage in prior controlled air incinerators, as well as controlled air incinerators utilizing a heat recovery system for saving energy, is that the combustion chamber could not be made large enough to take care of waste material available or to supply heat over a long period of time to render such system economical for installation in large industrial plants. Such prior systems ordinarily required a number of smaller units, if the system was to be utilized as a twenty-four hour operation for supplying heat to a large building. Additionally, such prior combustion systems did not provide for complete combustion of all of the waste material fed to the combustion chamber, especially when the waste material was highly compacted as it entered the combustion chamber. The resultant charge of burning waste material was such that it would burn about the periphery of the charge and the tightly packed waste material in the center of the charge was starved from the oxygen of the combustion air resulting in incomplete combustion.

PRIOR ART

The following patents are representative of prior art arrangements related to charging of incinerators or furnaces with combustionable products as well as removal of ash therefrom:

| U.S. Pat. No. | NAME | DATE |
|---|---|---|
| 1,838,014 | UHDE et al | December 22, 1931 |
| 3,031,981 | SMAUDER | May 1, 1962 |
| 3,680,719 | REILLY | August 1, 1972 |
| 3,708,078 | CLEMENTS | January 2, 1973 |
| 3,746,521 | GIDDINGS | July 17, 1973 |
| 3,749,031 | BURDEN, JR. | July 31, 1973 |

BRIEF DESCRIPTION OF THE INVENTION

The present invention provides an improved controlled air incinerator which has an elongated casing defining a combustion chamber having a generally horizontal axis. The combustion chamber is provided with a stepped floor therein with at least one riser facing the outlet end of the combustion chamber and defining a higher floor area adjacent to the inlet end of the combustion chamber and a lower floor area adjacent to the outlet end of the combustion chamber. Means are provided for loading waste through one end wall of the combustion chamber onto the higher floor area, the loading means also causing the moving of burning waste material on the higher floor area away from the inlet end and causing this burning waste material to be moved off the higher floor area and to tumble onto the lower floor area so as to disturb the burning waste material and cause any unburned waste material in the burning waste material to be exposed to more combustion air to enhance combustion. The outlet end of the combustion chamber remote from the inlet end is provided with means for removing ash therefrom.

More specifically, the controlled air incinerator is provided with ram means having a pusher wall defining at least a portion of the riser when in a retracted position, the ram means being movable forward across the lower floor area within the combustion chamber to an extended position so as to move burning waste material previously deposited thereon further towards the outlet end of the combustion chamber. Air injection means are carried by the ram means for injecting combustion air into the combustion chamber and into the interior of the burning waste material, the air injector means also including means to cool the ram means at least when the ram means is extended.

A more preferable form of the invention is to provide an elongated combustion chamber with a stepped floor defined by a plurality of steps extending downwardly from the inlet end and progressively toward the outlet end of the combustion chamber, each of the adjacent steps of the floor of the combustion chamber being separated by a riser and each step defining a separate burning area for waste material at a different elevation. A plurality of transfer ram members are provided with one transfer ram member being positioned beneath each step and when in its retracted position having a pusher wall defining at least a portion of the riser between the adjacent steps, the pusher wall being arranged to move over the next adjacent lower step toward the outlet end of the combustion chamber. Means are provided to cool each of the transfer members as well as to inject combustion air into burning material in front of the pusher wall of the particular transfer ram member so that combustion air is supplied to the interior of the burning mass of waste material. By utilizing a series of transfer ram members with relatively short strokes, an elongated combustion chamber having a horizontal axis can be used, as the burning waste material may be progressively moved from the inlet end to the outlet end during its burning cycle. A single transfer ram member used in an elongated combustion chamber presents difficulties structurally because of its long stroke and because it would require the incinerator system to have an overall horizontal length much greater than when a plurality of transfer rams are used for the same capacity combustion chamber. Additionally, a single transfer ram for use within the combustion chamber would not result in the disturbance of the burning waste material as realized by using a plurality of transfer rams in such a combustion chamber having a plurality of steps defining the floor from the inlet end to the outlet end. The tumbling action of the burning waste material from one step to the next succeeding step and so forth throughout the horizontal length of the combustion chamber results in the waste material being sufficiently disturbed so as to be completely presented to combustioned air whereby there can be more complete combustion.

By utilizing automatic loading means for loading waste material into the combustion chamber without the entrance of atmospheric air during loading and by utilizing an automatic ash removal means which effectively blocks atmospheric air from entering therethrough into the combustion chamber, the incinerator of the present invention with the stepped floor providing different zones at different elevations for burning of waste material, results in a system wherein the combustion chamber can be quite accurately controlled. Thermocouples spaced horizontally along the length of the elongated combustion chamber provide monitoring means for monitoring the temperature throughout the combustion chamber so that actuation of the rams can be programmed to control movement of the burning waste material whereby the system may be efficiently operated for complete combustion of waste material and for efficient operation of a heat recovery system of flue gases when such an incinerator is provided with the same.

These and other objects and advantages of the present invention will appear more fully in the following Detailed Description of the Invention, Claims and Description of the Drawings.

DETAILED DESCRIPTION OF THE INVENTION

Figure 1:
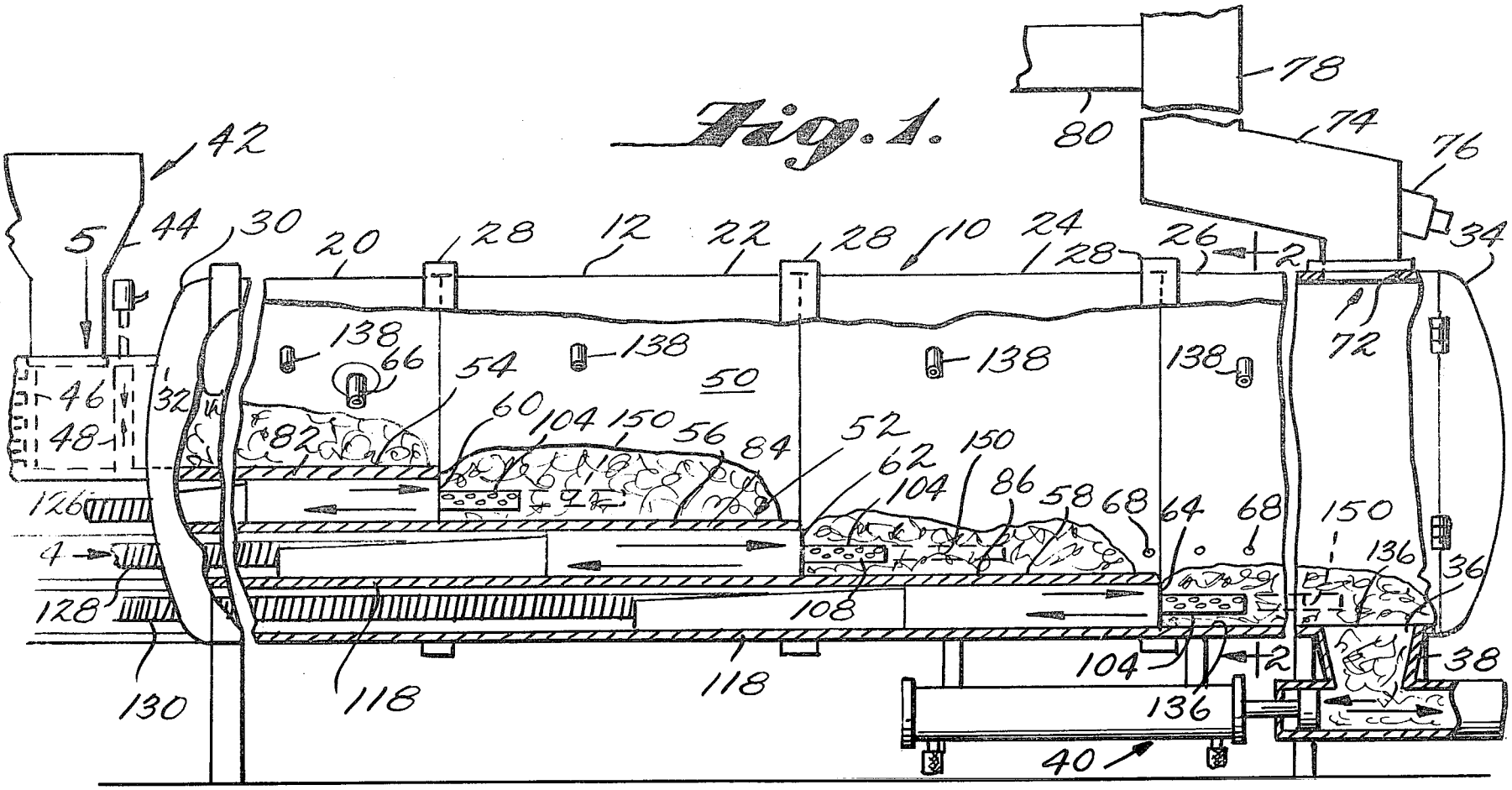
FIG. 1 is a diagrammatic view, partly in side elevation and partly in cross-section and with certain parts omitted for clarity, and illustrates the controlled air incinerator of the present invention.
Figure 3:
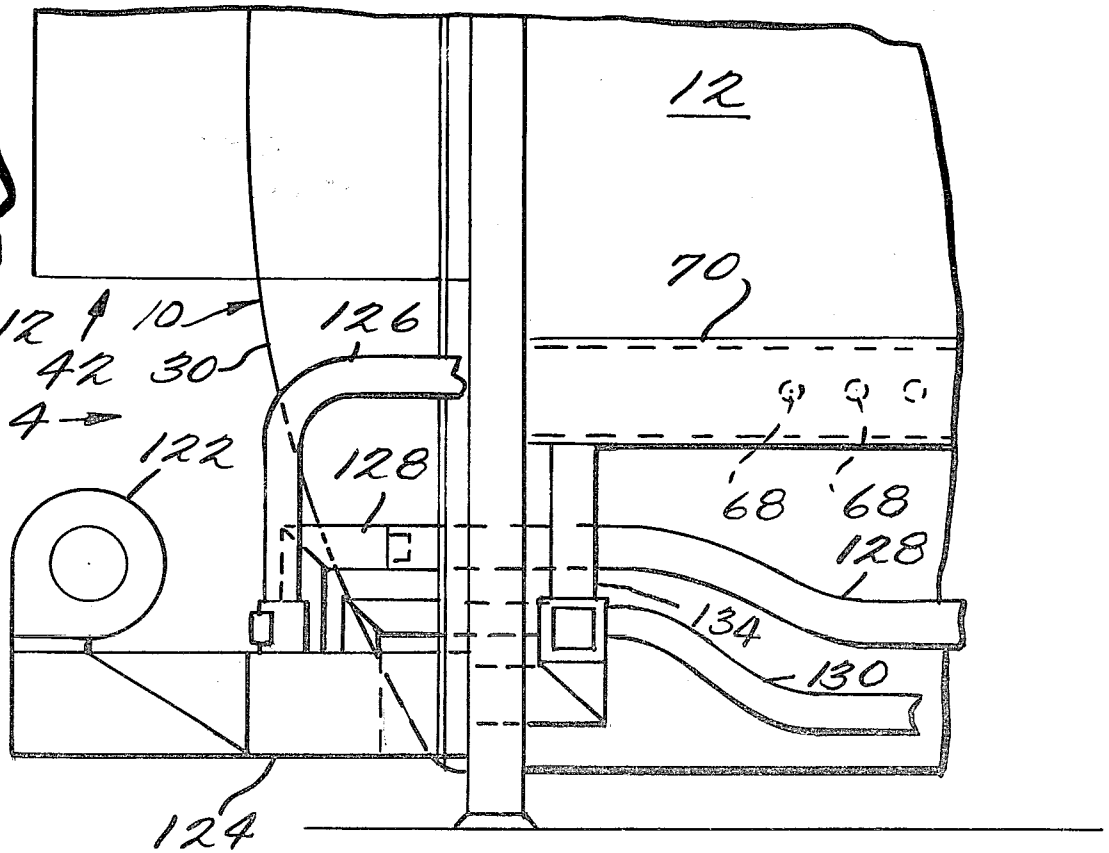
FIG. 3 is an enlarged fragmentary view of the lower left hand portion of FIG. 1, the view illustrating elements of the air supply means left out of FIG. 1 for the purpose of clarity.
Figure 2:
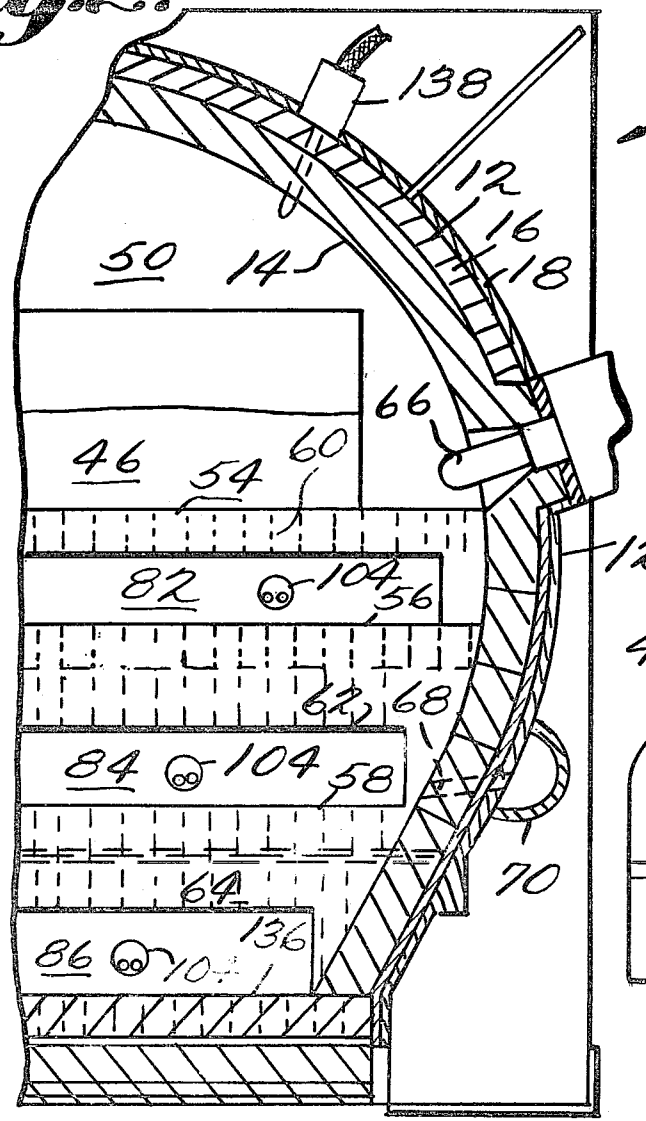
FIG. 2 is an enlarged fragmentary vertical cross-sectional view of approximately one-half of the incinerator of FIG. 1, the view being taken substantially on the line 2—2 of FIG. 1.
Figure 4:
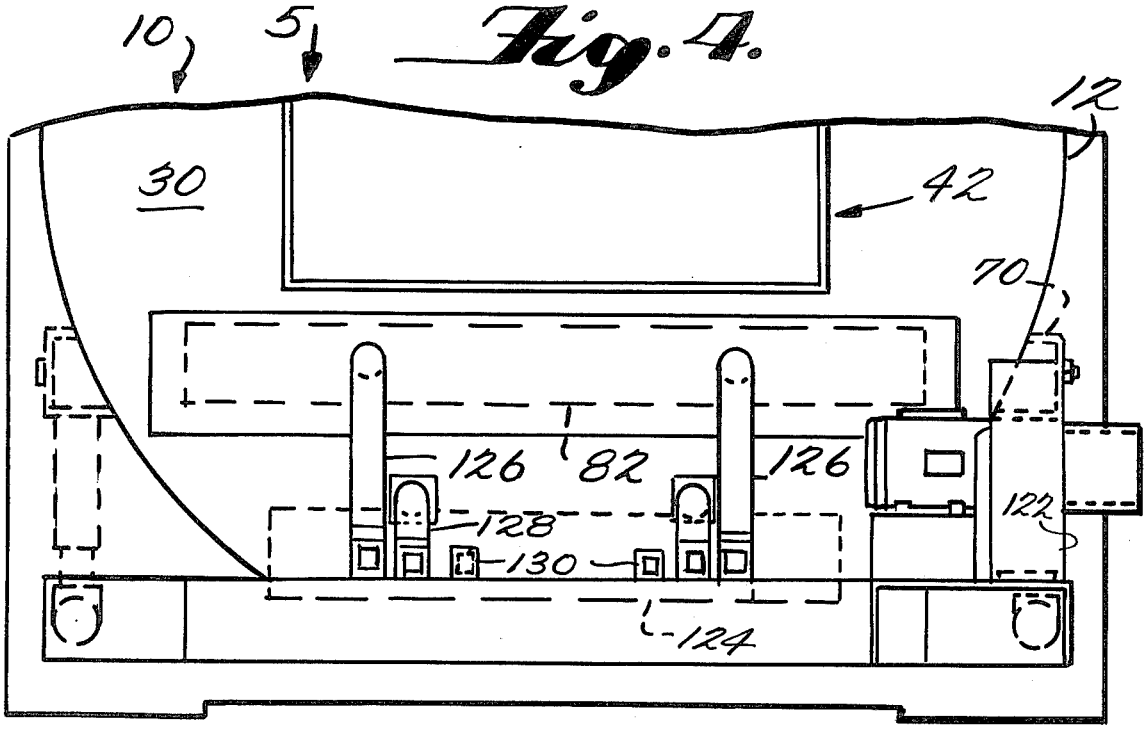
FIG. 4 is an enlarged fragmentary end view of the incinerator looking in the direction of the arrow 4 of FIG. 3.
Figure 5:
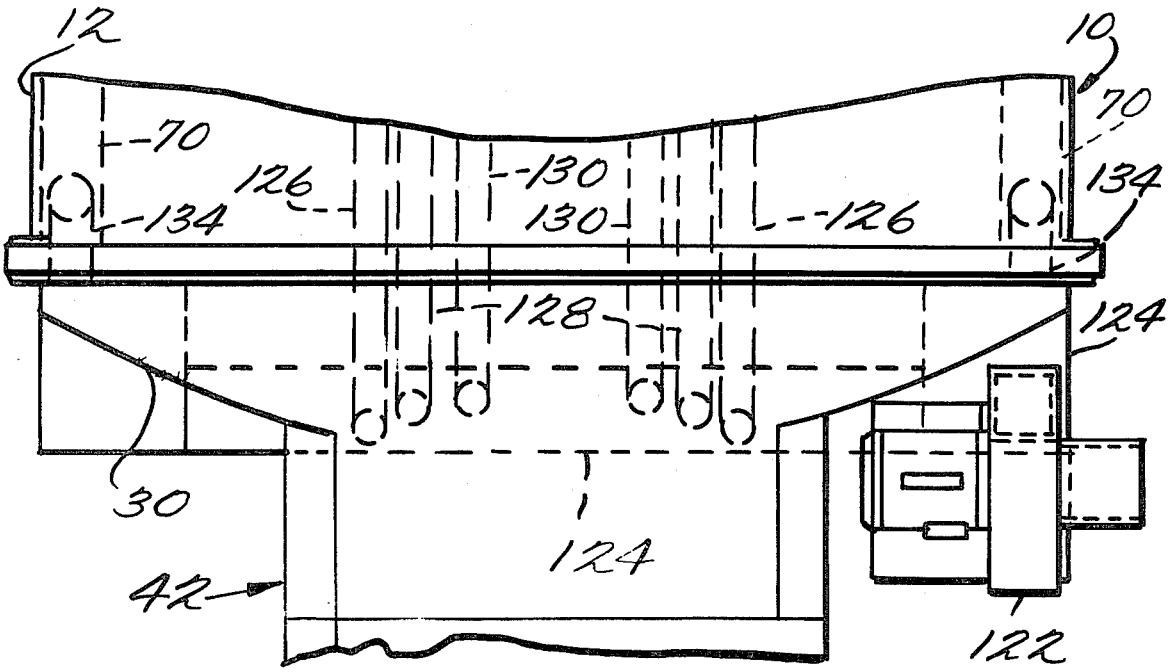
FIG. 5 is a fragmentary plan view of the end portion of the incinerator looking in the direction of the arrow 5 on FIG. 1 or FIG. 4 and with portions of the waste material loading means being omitted for purposes of clarity.

Referring now to the drawings wherein like characters or reference numerals represent like or similar parts, a combustion air incinerator for the present invention is generally designated by the reference number 10. The incinerator 10 includes an annular casing 12 provided with suitable refractory bricks 14, mineral wool block insulation 16 and an outer metallic shell 18. Preferably, the elongated annular casing 12, which defines a combustion chamber 50 having a horizontal axis, is made in a plurality of sections 20, 22, 24 and 26, the sections after manufacture being attached to one another in sealing relationship as indicated at 28.

Casing 10 is provided with an end wall 30 at its inlet end, the end wall 30 being provided with an opening 32 through which waste material is loaded. The opposite or outlet end of the casing 10 is provided with an end wall 34 in the form of a large access door which may be opened when the incinerator is inoperative for the purpose of cleaning the interior. Additionally, the incinerator 10 is provided at its outlet end with an opening 36 in its floor and an annular member 38 extends downwardly from the casing 10 around the opening 36 and defines an ash pit for discharging ashes during operation of the incinerator. In more detail, an automatic ash removal means 40 is used in conjunction with the ash pit 38, the ash removal means 40 being preferably of the type disclosed in the aforementioned U.S. Pat. No. 3,855,950.

An automatic means for loading waste material into and through the opening 32 in the inlet end wall 30 of the incinerator 10 is generally shown at 42, this automatic loading means being preferably of the type also disclosed in the aforementioned U.S. Pat. No. 3,855,950. It includes a hopper 44, ram means 46 and a fire door 48, the ram means 46 being capable of being extended forwardly when the fire door is opened so as to move waste material from the hopper into the inlet end of the incinerator 10.

The elongated combustion chamber 50 is provided with a stepped floor generally designated at 52 and including a plurality of steps 54, 56 and 58 separated by risers 60, 62 and 64, the step extending downwardly from the inlet end toward the outlet end. A more detailed description of the stepped floor 52 and its function in the burning action of the waste material will follow later in the specification.

The combustion chamber 50 is provided with one or more of the usual pressure burners 66 at least adjacent its inlet end, the burners having nozzles extending within the chamber for starting the burning process of the waste material. The burners 66 are normally turned off after combustion of the waste material has started and once controlled temperatures are reached within the combustion chamber. As will be appreciated by those skilled in the art, combustion air is supplied in controlled amounts to the combustion chamber 50 by means of a plurality of holes 68 extending from the exterior of the casing to the interior of the casing, the holes being covered on the exterior of the casing by an air manifold 70. The controlled amounts of air supplied in this manner to the combustion chamber 50 is disclosed in U.S. Pat. No. 3,489,109, issued Jan. 13, 1970 to Flowers and having a common assignee with this application. To this extend, the disclosure of U.S. Pat. No. 3,489,109 is also incorporated herein by reference.

At the outlet end of the combustion chamber 50, there is provided an opening 72 for exhaust gases, the opening 72 being in communication with a second combustion chamber or zone 74 having a pressure burner 76 with a nozzle therein, the secondary combustion chamber being provided for burning any combustible pollution particles in the exhaust gases. This arrangement may also be of the type disclosed in the aforementioned U.S. Pat. No. 3,489,109 or U.S. Pat. No. 3,403,645, issued Oct. 1, 1968 to Flowers and having a common assignee with this application. The secondary combustion chamber 74 discharges clean flue gases into a stack assembly 78, the stack assembly being of the type which may discharge the flue gases direct to atmosphere or being of the type such as shown in the aforementioned U.S. Pat. No. 3,844,233 which includes heat exchanger means 80 for recovering energy from heat of the flue gases for auxiliary uses.

Figure 6:
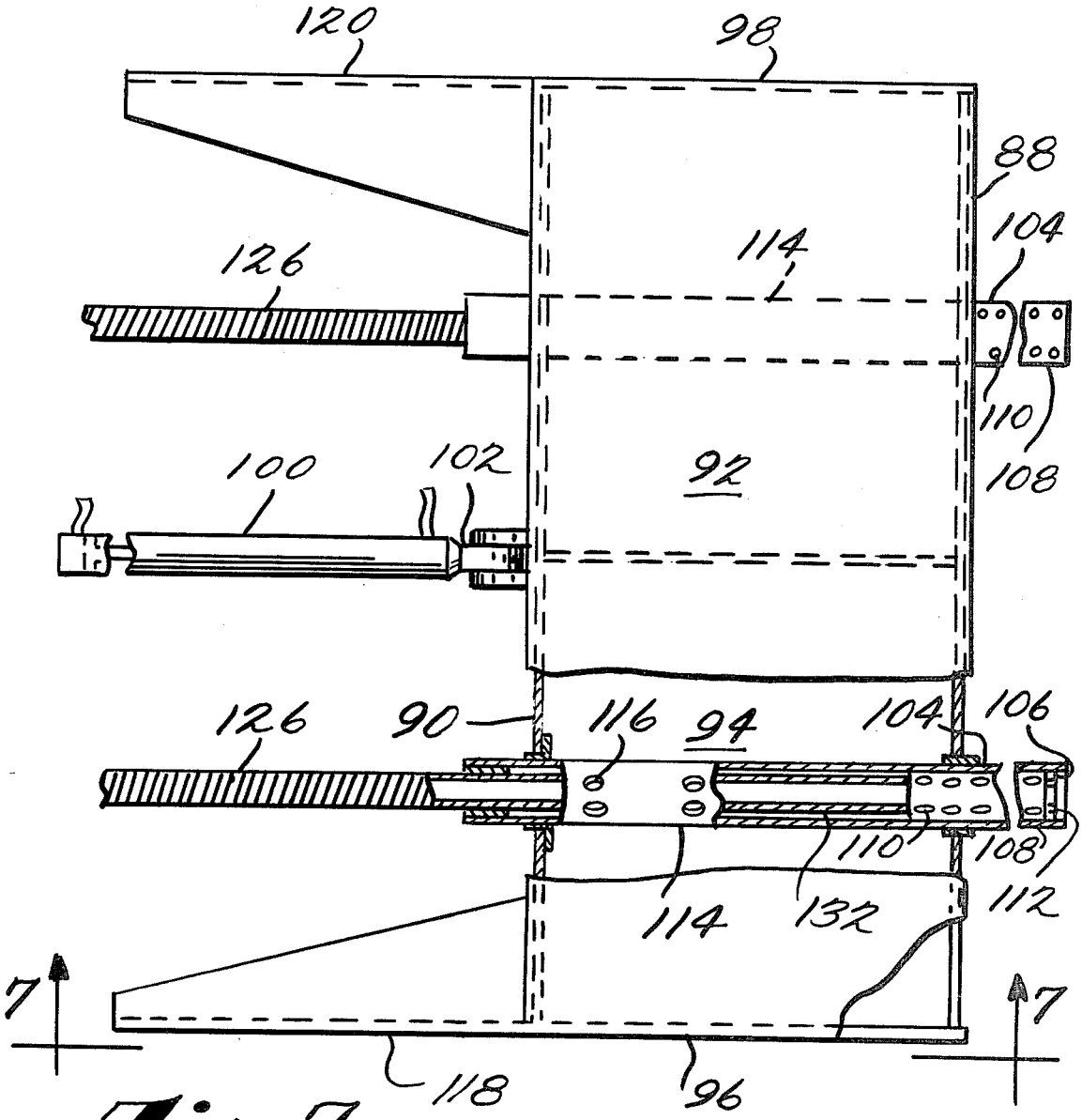
FIG. 6 is an enlarged plan view partly in section of one of the transfer ram members for moving burning waste material within the combustion chamber.
Figure 7:
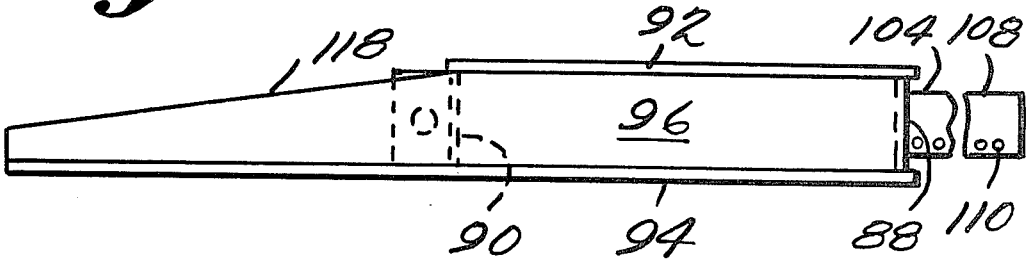
FIG. 7 is an end view of the transfer ram member of FIG. 6 taken on the line 7—7 in FIG. 6.

Referring now specifically to FIGS. 1, 6 and 7, it will be noted that beneath each of the steps 54, 56 and 58 there is positioned transfer ram members 82, 84 and 86, each of the transfer ram members being substantially identical. One such transfer ram member is shown in FIGS. 6 and 7 and a description of the same will suffice for all transfer members. Each transfer ram member is boxed-shaped and includes a pusher wall 88, an oppositely disposed rear wall 90, a top wall 92, a bottom wall 94, and side walls 96 and 98. The pusher wall 88 for each of the transfer ram members 82, 84 and 86 defines at least a portion of the risers 60, 62 and 64 of the downwardly stepped floor 52 when the particular transfer ram member is in its retracted position. Each transfer ram member is reciprocated by means of a hydraulic cylinder assembly 100 having a piston rod 102 connected to the particular transfer ram member.

A tubular nozzle member 104 closed at its outer end at 106 and open at its inner end extends through the pusher wall 88 and the rear wall 90 of the transfer ram member, the nozzle member being secured thereto. Preferably there are two nozzle members 104 for each transfer ram member and a portion 108 of the nozzle member 104 which extends forward of the pusher wall 88 has perforations 110 in its wall. Additionally, the closed end 106 has perforations 112 therein. Between the front and rear walls 88 and 90, a portion 114 of the nozzle member 104 is also perforated as indicated at 116.

Each transfer ram member further has its side walls 96 and 98 provided with rearwardly extending extensions 118 and 120, these extensions functioning as guide means for the transfer ram member when the same is extended within the combustion chamber 50.

Means for supplying air to the nozzle members 104 includes a fan or blower 122 which supplies air to a manifold system 124, the manifold system individually supplying air through conduits 126, 128 and 130 to the tubular nozzle members 104 of the respective transfer ram members 82, 84 and 86. In more detail, the conduits 126 have their open free ends 132 telescopingly received within the portion 114 of the nozzle member 104 between the pusher member 88 and the rear wall 90 as best shown in FIG. 6. The fan or blower 122 can also be used to supply air by a conduit 134 to the manifold 70 which in turn supplies combustion air to the interior of the combustion chamber 50 through the holes 68.

Each step 54, 56 and 58 and the bottom level 136 of the floor 52 define a burning zone or area with the areas decreasing in elevation from the inlet end to the outlet end of combustion chamber 50. A thermocouple 138 may be provided in each area so that the temperature at horizontally spaced points within the combustion chamber 50 can be accurately monitored and, of course, the actuation of the transfer ram members may be programmed to the temperatures in the various zones. Additionally, the amount of air supplied for combustion to the combustion chamber 50 can also be programmed depending upon the temperature variations and the temperatures of the zones.

In operation of the incinerator 10, waste material is loaded into the hopper 44 and it is fed into the combustion chamber 50 by extension of the ram means 46 at least to and possibly through the opening 32 in the end wall 30 of the casing 12. The waste material is initially deposited on the step 54 and is ignited by the pressure burner 66. Once an initial charge has been placed on the step 54 and is burning, then an additional charge of waste material may be loaded into the combustion chamber 50 by the ram means 46, this new charge of waste material pushing the previously deposited and burning charge of waste material off of the step 54 where it falls or tumbles onto the step 56 in front of the pusher wall 88 of the transfer ram member 82. The tumbling of the waste material causes the same to open up as it falls around the projecting portion 108 of the tubular nozzle member 104 and combustion air passing through the holes 110 and 112 result in the unburned waste material being exposed thereto so that it can burn.

As more waste material is loaded into the combustion chamber 50, and the step 56 becomes filled with burning waste material, the transfer ram 82 is actuated and its pusher wall 88 will push the burning waste material in front of the same and on the step 56 off of the step so that it tumbles onto step 58 in front of the pusher wall 88 of the transfer ram 84. When the transfer ram 82 is withdrawn or retracted, the projecting portion 108 of the nozzle member 104 in front of the pusher wall 88 is withdrawn from waste material on the step 56 and leaves a hole 150 in waste material and, thus, the air issuing axially of the nozzle member through the holes or perforations 112 can get into the middle of the burning mass of waste material still remaining on the step 56.

The above described operation is repeated when it is necessary to remove waste material from the successive steps by the actuation of the particular transfer ram members 84 and 86 with the transfer ram member 86 pushing the burning waste material and resulting ashes across the lowest level of the floor 136 into the opening 36 wherein the ashes are removed by the automatic ash removal means 40. As will now be evident, combustion air is not only supplied into the combustion chamber 50 along the side walls of the same through the holes 68, but combustion air is also supplied into the middle of and mixed with the burning mass of waste material so as to expose the same to the oxygen of the air to assist in supporting full combustion of the same.

When the transfer ram members 82, 84 and 86 are in their extended positions, the portion 132 of the conduits 126 will uncover perforations 116 in the portion 114 of the nozzle member 104. This results in a portion of the cold air supplied by the conduits 126 to be discharged through perforations 116 and, thus, cool the bottom wall 94, top wall 92 and the remaining portions of the transfer ram members whereby the life of such transfer ram members is increased. The overall operation of the transfer ram member, as previously described, is dependent upon the operating condition required and maintained within the combustion chamber. In other words, all transfer ram members 82, 84 and 86 may be simultaneously extended and retracted or may be selectively extended or retracted depending upon burning conditions within the combustion chamber and depending upon the program set up by the operator of the equipment.

The terminology used in this specification is for the purpose of description and not limitation, the scope of the invention being defined in the claims.

I claim:

1. A controlled air incinerator for burning waste material comprising:

an elongated casing defining a combustion chamber having a generally horizontal axis, said casing having end walls for the combustion chamber at an inlet end for waste material and at an outlet end for ash respectively, and said combustion chamber of said casing having a stepped floor therein with at least one riser facing the outlet end of the combustion chamber, said riser defining a higher floor area adjacent the inlet end of the combustion chamber and a lower floor area adjacent the outlet end of the combustion chamber;

means for loading waste material into the combustion chamber of said casing through the one end wall thereof adjacent the inlet end on to the higher floor area, said means for loading waste material also causing moving of burning waste material within the combustion chamber on the higher floor area away from the inlet end and causing this burning material to move off the higher floor area and tumble onto the lower floor area so as to cause any unburned waste material in the burning waste material to be exposed to more combustion air;

ram means having a pusher wall defining a portion of said riser when in a retracted position, said ram means being movable forward across said lower floor area within the combustion chamber to an extended position to move burning waste material thereon further towards said outlet end of the combustion chamber;

air injection means carried by said ram means for injecting air into said combustion chamber and into the burning waste material on said lower floor area;

said air injection means including at least one nozzle fixed to said ram means and having a first portion extending through said pusher wall, said portion being perforated with apertures to supply air at least transversely of the axis of the same; and means adjacent the outlet end of said combustion chamber remote from the inlet end for removing ash therefrom.

2. A controlled air incinerator as claimed in claim 1 wherein said ram means is box-shaped and has a rear wall connected to top, bottom and side walls, said bottom and side walls also being connected to said pusher wall, said top wall providing a continuation of said upper floor area when said ram means is in the extended position.

3. A controlled air incinerator as claimed in claim 2 wherein a second portion of said nozzle extends within said box-shaped ram means and is provided with further apertures for cooling said top, bottom and side walls and said pusher wall of said ram means at least when said ram means is in the extended position.

4. A controlled air incinerator as claimed in claim 1 in which said nozzle is provided with apertures in the end of said first portion of the same for injecting air axially outwardly of said nozzle.

5. A controlled air incinerator as claimed in claim 1 including blower means, a manifold extending from said blower means and telescopingly received in said air injection nozzle, said blower means providing air to said nozzle.

6. A controlled air incinerator as claimed in claim 1 wherein said means for loading waste material through the combustion chamber includes ram means movable from a retracted position for receiving waste material to a forward position within an opening in the end wall of the inlet end of said combustion chamber.

7. A controlled air incinerator for burning waste material comprising:

an elongated casing defining a combustion chamber having a generally horizontal axis, said combustion chamber having an inlet end for receiving waste material and an outlet end for discharge of ash, and said combustion chamber having a stepped floor defined by a plurality of steps extending downwardly from the inlet end progressively toward the outlet end of the combustion chamber, adjacent steps being separated by a riser and each step defining a burning area for waste material at a different elevation;

means for loading waste material from the exterior of said casing into the inlet end of said combustion chamber onto a first of said steps, said means also causing moving of previously deposited and burning waste material from said first step onto a next succeeding step to thereby cause the burning waste material to tumble and expose any still unburned waste material to combustion air;

a plurality of transfer ram members, one of said transfer members being positioned beneath said first step and each of said succeeding steps when in its retracted position, each of said transfer members having a pusher wall defining when in the retracted position at least a portion of the riser between adjacent steps, each of said transfer ram members being extendable within the combustion chamber across a next succeeding step to move burning waste material therefrom and to cause the same to tumble onto a next following step so as to expose any still unburned waste material to combustion air and to progressively move burning waste material toward the outlet end of the combustion chamber;

means for cooling each of said transfer ram members and for injecting air into burning waste material in front of the pusher wall of each of said transfer ram members, said air cooling and injecting means including at least one tubular nozzle member extending through the pusher wall of each of said transfer members, each tubular nozzle member being perforated on both sides of the pusher wall whereby a portion of air supplied thereto is injected into burning waste material and a second portion of air flows over the transfer ram member to cool the same; and means at the outlet end of said combustion chamber for removing ash from the combustion chamber.

8. A controlled air incinerator as claimed in claim 7 in which said air cooling and injection means further includes a blower, a plenum chamber connected to said blower, a conduit means extending from said plenum chamber to each of said nozzle members of said transfer rams.

9. A controlled air incinerator as claimed in claim 7 wherein at least two horizontally spaced nozzle members are provided for each of said transfer ram members.

10. A controlled air incinerator as claimed in claim 7 including a plurality of horizontally spaced holes extending from the exterior of and through said casing to the interior of said combustion chamber along the length of the same, and a manifold carried on the exterior of said casing for supplying combustion air to the holes and to said combustion chamber.

11. A controlled air incinerator as claimed in claim 7 wherein said means for removing ash includes an access door on said casing at the outlet end of said combustion chamber, said access door permitting access to the interior of said casing when the incinerator is inoperative.

12. A controlled air incinerator as claimed in claim 7 wherein each tubular nozzle member is provided with perforations on its forward end for injecting combustion air axially therefrom into burning waste material.

13. A controlled air incinerator as claimed in claim 7 including a plurality of horizontally spaced thermocouple means positioned in said combustion chamber for monitoring temperature of combustion zones from the inlet end to the outlet end thereof.

14. A controlled air incinerator as claimed in claim 7 in which said means at the outlet end of said combustion chamber for removing ash therefrom includes an opening in the floor of said combustion chamber at the outlet end thereof, an annular member connected to said casing and surrounding said opening and defining an ash pit, and automatic ash removal means connected to the lower end of said annular member.

15. A controlled air incinerator as claimed in claim 14 including an access door on said casing at the outlet end of the combustion chamber and defining an end wall, said access door permitting access to the interior of said casing when the incinerator is inoperative.

16. A controlled air incinerator as claimed in claim 7 in which each of said transfer ram members is box-shaped and includes in addition to said pusher wall, an oppositely disposed rear wall, a top wall, a bottom wall and side walls, said top wall providing a continuation of the step under which the particular transfer ram member is positioned when the transfer ram member is extended into the combustion chamber.

17. A controlled air incinerator as claimed in claim 16 in which each of the side walls of each of said transfer rams is provided with a portion extending rearwardly of the rear wall, said rearwardly extending portions providing guide means for the transfer ram members when the same are extended into the combustion chamber.

18. A controlled air incinerator as claimed in claim 7 in which said air cooling and air injecting means further includes a blower, a plenum chamber connected to said blower, individual conduits operatively extending from said plenum chamber to each of said nozzle members, each of said conduit members and end portion telescopingly having an sealingly received in the tubular nozzle member for sliding movement relative thereto.

19. A controlled air incinerator as claimed in claim 16 including at least one row of a plurality of horizontally spaced holes extending from the exterior of and through said casing to the interior of said combustion chamber along at least a portion of at least one side of the casing, and a manifold carried on the exterior of said casing and over said holes for supplying combustion air to the holes and to said combustion chamber.

20. A controlled air incinerator as claimed in claim 7 in which said means for loading waste material from the exterior of the casing into the inlet end of the combustion chamber onto the first of said steps and for causing movement of previously deposited burning waste material from the first step to the next succeeding step includes ram means movable from a retracted position for receiving waste material to a forward position adjacent an opening in said casing at the inlet end of said combustion chamber.

21. A controlled air incinerator as claimed in claim 20 wherein said means at the outlet end of said combustion chamber for removing ash therefrom includes an opening in the floor of the combustion chamber, an annular member connected to said casing and surrounding said opening and defining an ash pit to receive ashes, and an automatic ash removal means connected to the lower end of said annular member.

* * * * *